US009670615B2

(12) United States Patent
Gingras

(10) Patent No.: US 9,670,615 B2
(45) Date of Patent: Jun. 6, 2017

(54) CONICAL ROTOR REFINER PLATE ELEMENT FOR COUNTER-ROTATING REFINER HAVING CURVED BARS AND SERRATED LEADING SIDEWALLS

(75) Inventor: Luc Gingras, Harrogate (GB)

(73) Assignee: Andritz Inc., Glens Falls, NY (US)

( * ) Notice: Subject to any disclaimer, the term of this patent is extended or adjusted under 35 U.S.C. 154(b) by 829 days.

(21) Appl. No.: 13/566,373

(22) Filed: Aug. 3, 2012

(65) Prior Publication Data

US 2013/0043338 A1 Feb. 21, 2013

Related U.S. Application Data

(60) Provisional application No. 61/525,441, filed on Aug. 19, 2011.

(51) Int. Cl.

| | |
|---|---|
| ***B02C 7/00*** | (2006.01) |
| ***D21D 1/24*** | (2006.01) |
| ***B02C 7/02*** | (2006.01) |
| ***D21D 1/30*** | (2006.01) |

(52) U.S. Cl.

CPC ..... *D21D 1/24* (2013.01); *B02C 7/02* (2013.01); *D21D 1/306* (2013.01)

(58) Field of Classification Search

CPC D21D 1/24; D21D 1/30; D21D 1/306; D21D 1/36; B02C 7/00; B02C 7/02; B02C 7/12

USPC ..... 241/261.2, 261.3, 245, 261.1

See application file for complete search history.

(56) References Cited

U.S. PATENT DOCUMENTS

| | | | | |
|---|---|---|---|---|
| 499,714 A * | 6/1893 | Corning | B02C 7/12 241/296 |
| 804,738 A | 11/1905 | Kreps | |
| 827,059 A | 7/1906 | Davis | |
| 1,187,360 A * | 6/1916 | Martin | B02C 7/12 241/296 |
| 1,609,717 A | 12/1926 | Holland-Letz | |
| 4,023,737 A | 5/1977 | Leider et al. | |

(Continued)

FOREIGN PATENT DOCUMENTS

| | | |
|---|---|---|
| FI | 53469 | 1/1978 |
| SE | 513 807 | 11/2000 |

(Continued)

OTHER PUBLICATIONS

European Search Report mailed Sep. 20, 2012.

*Primary Examiner* — Faye Francis

(74) *Attorney, Agent, or Firm* — Kerri Hochgesang; Robert Joseph Hornung

(57) ABSTRACT

A refining plate segment for a mechanical refiner of ligno-cellulosic material including: a convex conical refining surface on a convex conical substrate of the plate, wherein the refining surface is adapted to face a concave conical refining surface of an opposing refiner plate, the convex conical refining surface including bars and grooves formed between adjacent bars, wherein an angle of each bar with respect to a reference line parallel to a rotational axis of the refiner increases at least 15 degrees and the angle is a holdback angle is 10 to 45 degrees at a periphery of the refining surface, and wherein the bars each include a leading sidewall having an irregular surface having protrusions extending outwardly from the sidewall toward a sidewall on an adjacent bar.

52 Claims, 4 Drawing Sheets

(56) References Cited

U.S. PATENT DOCUMENTS

| | | | | |
|---|---|---|---|---|
| 4,712,745 | A | 12/1987 | Leith | |
| 5,165,592 | A | 11/1992 | Wasikowski | |
| 5,362,003 | A | 11/1994 | Virving | |
| 5,425,508 | A | 6/1995 | Chaney | |
| 5,467,931 | A | 11/1995 | Dodd | |
| 5,683,048 | A | 11/1997 | Virving | |
| 5,690,286 | A | 11/1997 | Dodd et al. | |
| 5,695,136 | A | 12/1997 | Rohden | |
| 6,042,036 | A * | 3/2000 | Virving et al. | 241/261.3 |
| 6,276,622 | B1 | 8/2001 | Obitz | |
| 6,402,071 | B1 * | 6/2002 | Gingras | D21D 1/306 241/261.2 |
| 6,592,062 | B1 | 7/2003 | Virving | |
| 7,398,938 | B2 * | 7/2008 | Antensteiner | B02C 2/10 241/261.2 |
| 7,419,112 | B2 | 9/2008 | Sjostrom et al. | |
| 7,445,174 | B2 * | 11/2008 | Virving | B02C 7/12 241/261.3 |
| 7,900,862 | B2 * | 3/2011 | Gingras | D21D 1/306 241/298 |
| 7,913,942 | B2 * | 3/2011 | Vuorio | D21D 1/306 241/261.2 |
| 8,157,195 | B2 | 4/2012 | Gingras | |
| 8,226,023 | B2 * | 7/2012 | Vuorio | B02C 7/12 241/261.3 |
| 2006/0006265 | A1 | 1/2006 | Sabourin et al. | |
| 2006/0289689 | A1 * | 12/2006 | Matthew | B02C 7/12 241/298 |
| 2008/0191078 | A1 * | 8/2008 | Gingras | 241/298 |
| 2010/0270411 | A1 * | 10/2010 | Vuorio et al. | 241/245 |
| 2013/0015281 | A1 * | 1/2013 | Gingras | D21D 1/306 241/296 |
| 2013/0043338 | A1 * | 2/2013 | Gingras | D21D 1/306 241/294 |
| 2014/0131489 | A1 * | 5/2014 | Gingras | B02C 7/12 241/28 |

FOREIGN PATENT DOCUMENTS

| | | | |
|---|---|---|---|
| WO | 00/56459 | 9/2000 | |
| WO | 2008/098153 | 8/2008 | |
| WO | WO 2008098153 A1 * | 8/2008 | D21D 1/30 |

* cited by examiner

CONICAL ROTOR REFINER PLATE ELEMENT FOR COUNTER-ROTATING REFINER HAVING CURVED BARS AND SERRATED LEADING SIDEWALLS

CROSS-REFERENCE TO RELATED APPLICATIONS

The present application claims the benefit of priority under U.S. Provisional Patent Application No. 61/525,441, having a filing date of Aug. 19, 2011, which is incorporated herein in its entirety by reference.

BACKGROUND OF THE INVENTION

1. Technical Field

The invention relates to conical refiners or disc-conical refiners for lignocellulosic materials, such as refiners used for producing mechanical pulp, thermomechanical pulp and a variety of chemi-thermomechanical pulps (collectively referred to as mechanical pulps and mechanical pulping processes).

2. Prior Art

Conical refiners, or conical zones of disc-conical refiners, are used in mechanical pulping processes. The raw cellulosic material, typically wood or other lignocellulosic material (collectively referred to as wood chips), is fed through the middle of one of the refiners discs and propelled outwards by a strong centrifugal force created by the rotation of a rotor disc. Refiner plates are mounted on each of the opposing faces of the refiner discs. The wood chips move between the opposing refiner plates in a generally radial direction to the outer perimeter of the plates and disc section when such a section exists (in disc-conical refiners). In conical refiners (or conical section of disc-conical refiners), the convex rotor element propels the wood chips into the concave stator element.

Steam is a major component of the feeding mechanism. Steam generated during refining displaces the wood chips through the conical zone.

In conical and disc-conical refiners, the refiner rotor conventionally operates at rotational speeds of 1500 to 2100 revolutions per minute (RPM). While the wood chips are between the refining elements, energy is transferred to the material via refiner plates attached to the rotor and stator elements.

The refiner plates generally feature a pattern of bars and grooves, as well as dams, which together provide a repeated compression and shear actions on the wood chips. The compression and shear actions acting on the material separates the lignocellulosic fibers out of the raw material, provides a certain amount of development or fibrillation of the material, and generates some amount of fiber cutting which is usually less desirable. The fiber separation and development is necessary for transforming the raw wood chips into a suitable board or paper making fiber component.

In the mechanical pulping process, a large amount of friction occurs, such as between the wood chips and the refiner plates. This friction reduces the energy efficiency of the process. It has been estimated that the efficiency of the energy applied in mechanical pulping is in the order of 10% (percent) to 15%.

Efforts to develop refiner plates which work at higher energy efficiency e.g., lower friction, have been achieved and typically involve reducing the operating gap between the discs. Conventional techniques for improving energy efficiencies typically involve design features on the front face of refiner plate segments that usually speed up the feed of wood chips across the refining zone(s) on the refiner plates. These techniques often result in reducing the thickness of the fibrous pad formed by the wood chips flowing between the refiner plates. When energy is applied by the refiner plates to a thinner fiber pad, the compression rate applied to the wood chips becomes greater for a given energy input and results in a more efficient energy usage in refining the wood chips.

Reducing the thickness of the fiber pad allows for smaller operating gaps, e.g., the clearance between the opposing refiner plates. Reducing the gap may result in an increase in cutting of the fibers of the wood chips, a reduction of the strength properties of the pulp produced by the discs, an increased wear rate of the refiner plates, and a reduction in the operating life of the refiner plates. The refiner plate operational life reduces exponentially as the operating gap is reduced.

The energy efficiency is believed to be greatest toward the periphery of the refiner discs, and in general, the same applies for both flat and conical refining zones. The relative velocities of refiner plates are greatest in the peripheral region of the plates. The refining bars on the refiner plates cross each other on opposing plates at a higher velocity in the peripheral regions of the refiner plates. The higher crossing velocity of the refining bars is believed to increase the refining efficiency in the peripheral region of the plates.

The wood fibers tend to flow quickly through the peripheral region of the conventional refiner plates, regardless of whether they are flat or conical in shape. The quickness of the fibers in the peripheral region is due to the effects of centrifugal forces and forces created by the forward flow of steam generated between the discs. The shortness of the retention period in the peripheral region limits the amount of work that can be done in that most efficient part of the refining surface.

BRIEF SUMMARY OF THE INVENTION

Designing the refiner plates to shift more of the energy input toward the periphery of the refining zone(s) should increase the overall refining efficiency and reduce the energy consumed to refine pulp. The refiner plates are designed to increase the retention period of the fibers in the periphery of the refining zone(s), thereby increasing and improving the refining efficiency. As the energy input is shifted to the periphery of the refining zone(s), operating gap between the refiner plates may be made sufficiently wide so as to provide a long operating life for the refiner plates.

A novel conical refiner plate has been conceived that, in one embodiment, has enhanced energy efficiency and allows for a relatively large operating gap between discs. The energy efficiency and large operating gap may provide reduced energy consumption to produce pulp, a high fiber quality of the produced pulp, and a long operating life for the refiner plate segments.

In one embodiment, the refiner plate is an assembly of convex conical rotor plate segments having an outer refining zone with bars that have at least a radially outer section with a curved longitudinal shape and leading sidewalls with wall surfaces that are jagged, serrated, or otherwise irregular. The irregular surface on the leading sidewall may also be embodied as protrusions that are semi-circular, rectangular or curvilinear in shape.

The curved bars and resulting curved grooves between bars increase the retention time of the wood chip feed material in the outer zone and thereby increase the refining of the material in the outer zone. Further, the jagged surfaces on the leading sidewalls also act to increase the retention time of feed material in the outer zone.

A refining plate has been conceived with a convex conical refining surface facing another plate; the convex refining surface includes a plurality of bars upstanding from the surface. The bars extend radially outward toward an outer peripheral edge of the plate, and have a jagged or irregular surface on at least the leading sidewall of the bars. The bars are curved, such as with an exponential or in an involute arc. The refining plate may be a convex conical rotor plate, and is arranged in a refiner opposite a concave conical stator plate.

A refining plate segment has been conceived for a mechanical refining of lignocellulosic material comprising: a convex conical refining surface on a substrate, wherein the refining surface is adapted to face a concave conical refining surface of an opposing refiner plate, the convex refining surface including bars and grooves between the bars, wherein an angle of each bar with respect to a radial line corresponding to the bar increases at least 15 degrees along a radially outward direction, and the angle is a holdback angle in a range of any of 10 to 45 degrees, 15 to 35 degrees, 15 to 45 degrees and 20 to 35 degrees at the periphery of the refining surface, and wherein the bars each include a leading sidewall having an irregular surface, wherein the irregular surface includes protrusions extending outwardly from the sidewall toward a sidewall on an adjacent bar, and the irregular surface extends from at or near the outer periphery of the refining surface, and extends radially inwardly along the bars and may not reach an inlet of the refining surface.

A refining plate segment has been conceived for a mechanical refiner of lignocellulosic material comprising: a convex conical refining surface on a substrate, wherein the refining surface is adapted to face a concave conical refining surface of an opposing refiner plate, the convex refining surface including bars and grooves between the bars, wherein an angle of each bar with respect to a radial line corresponding to the bar increases at least 15 degrees along a radially outward direction, and the angle is a holdback angle in a range of 10 to 45 degrees or 15 to 35 degrees at the periphery of the refining surface, and wherein the bars each include a leading sidewall having an irregular surface that includes recesses in the bar extending outwardly from the sidewall toward a sidewall on an adjacent bar, and the irregular surface extends from at or near the outer periphery of the refining surface and extends radially inward along the bars and may not reach an inlet of the refining surface.

The bars may each have a curved longitudinal shape with respect to a radial of the plate extending through the bar. The angles may increase continuously and gradually along the radially outward direction or in steps along the radially outward direction. At the radially inward inlet to the refining surface, the bars may be each arranged at an angle within 10, 15 or 20 degrees of a radial line corresponding to the bar. Further, the refining plate segment may be adapted for a rotating refining disc and to face a rotating refining disc when mounted in a refiner.

The refining surface may include multiple refining zones, wherein a first refining zone has relatively wide bars and wide grooves and a second refining zone has relatively narrow bars and narrow grooves, wherein the second refining zone is radially outward on the plate segment from the first refining zone, and wherein the holdback angle for the second refining zone may be in a range of any of 10 to 45, 15 to 45 and 20 to 35.

The irregular surface on the leading sidewall of the bars may include a series of ramps, each having a lower edge at the substrate of each groove, extending at least partially up the leading sidewall. The irregular surface on the leading sidewall may be embodied as protrusions on the semi-circular, rectangular or curvilinear shapes.

A refiner plate has been conceived for a mechanical refiner of lignocellulosic material comprising: a convex conical refining surface on a substrate, wherein the refining surface is adapted to face a concave conical refining surface of an opposing refiner plate, and the convex refining surface includes bars and grooves between the bars, wherein the bars have at least a radially outer section having an angle of each bar with respect to a corresponding radial line at the inlet of the bar within 10, 15 or 20 degrees of the radial line, and the holdback angle is an angle in a range of any of 10 to 45, 15 to 35, 15 to 45 and 20 to 35 at an outer periphery of the bars, wherein the angle increases at least 10 to 15 degrees from a radially inward inlet of the bars to the outer periphery, and the bars each include a sidewall having an irregular surface in a radially outer section, wherein the irregular surface includes protrusions extending outwardly from the sidewall toward a sidewall on an adjacent bar, wherein the bars each include a leading sidewall having an irregular surface, wherein the irregular surface includes protrusions extending outwardly from the sidewall toward a sidewall on an adjacent bar, and the irregular surface extends from at or near the outer periphery of the refining surface, and extends radially inward along the bars and may not reach an inlet of the refining surface.

In another embodiment, a refiner plate has been conceived for a mechanical refiner of lignocellulosic material comprising: a convex conical refining surface on a substrate, wherein the refining surface is adapted to face a concave conical refining surface of an opposing refiner plate, and the convex refining surface includes bars and grooves between the bars, wherein the bars have at least a radially outer section having an angle of each bar with respect to a corresponding radial line at the inlet of the bar within 10, 15 or 20 degrees of the radial line, and the holdback angle is an angle in a range of any of 10 to 45, 15 to 35, 15 to 45 and 20 to 35 at an outer periphery of the bars, wherein the angle increases at least 10 to 15 degrees from a radially inward inlet of the bars to the outer periphery, and the bars each include a sidewall having an irregular surface in a radially outer section, wherein the irregular surface includes recesses in the bar extending outwardly from the sidewall toward a sidewall on an adjacent bar, wherein the bars each include a leading sidewall having an irregular surface, wherein the irregular surface includes recesses in the bar extending outwardly from the sidewall toward a sidewall on an adjacent bar, and the irregular surface extends from at or near the outer periphery of the refining surface, and extends radially inward along the bars and may not reach an inlet of the refining surface.

A refining plate segment has been conceived for a mechanical refiner of lignocellulosic material comprising: a convex conical refining surface on a substrate, wherein the refining surface is adapted to face a concave conical refining surface of an opposing refiner plate; the convex refining surface including bars and grooves between the bars, wherein each bar is at an angle with respect to a radial line corresponding to the bar, and the angle at the inlet to the bars within 10, 15 or 20 degrees of the radial line, the angle increases at least 10 to 15 degrees in a radially outward direction along the bar, and the angle is in a range of any of 10 to 45, 15 to 35, to 45 and 20 to 35 at the periphery of the refining surface, and wherein the bars each include a leading sidewall having an irregular surface, wherein the irregular surface includes protrusions extending outwardly from the sidewall toward a sidewall on an adjacent bar, and the irregular surface extends from at or near the outer periphery of the refining surface, and extends radially inward along the bars and may not reach an inlet of the refining surface.

In another embodiment, a refining plate segment has been conceived for a mechanical refiner of lignocellulosic material comprising: a convex conical refining surface on a substrate, wherein the refining surface is adapted to face a concave conical refining surface of an opposing refiner plate; the convex refining surface including bars and grooves between the bars, wherein each bar is at an angle with respect to a radial line corresponding to the bar, and the angle at the inlet to the bars is within 10, 15 or 20 degrees of the radial line, the angle increases at least 10 to 15 degrees in a radially outward direction along the bar, and the angle is in a range of any of 10 to 45, 15 to 35, 15 to 45 and 20 to 35 at the periphery of the refining surface, and wherein the bars each include a leading sidewall having an irregular surface, wherein the irregular surface includes recesses in the bar extending outwardly from the sidewall toward a sidewall on an adjacent bar, and the irregular surface extends from at or near the outer periphery of the refining surface, and extends radially inward along the bars and may not reach an inlet of the refining surface.

DETAILED DESCRIPTION OF THE INVENTION

A conical rotor refiner plate has been conceived with a relatively coarse bar and groove configuration, and other features to provide for a long retention time for the fibrous pad in the effective refining zone at a peripheral region of that zone. These features concentrate the refining energy by surface area toward the periphery of the refining surface, together with a lower number of bar crossings (less compression events) and a much longer retention time for the raw material, caused by the specific design of the conical rotor elements or conical rotor refiner plates. This results in a high compression rate of a thick fiber mat, thus maintaining a larger operating gap. Instead of achieving high intensity by reducing the amount of fiber between the opposing plates, high intensity compressions are achieved by lowering the number of bar crossing events and increasing the amount of fiber present at each bar crossing.

Figure 1:
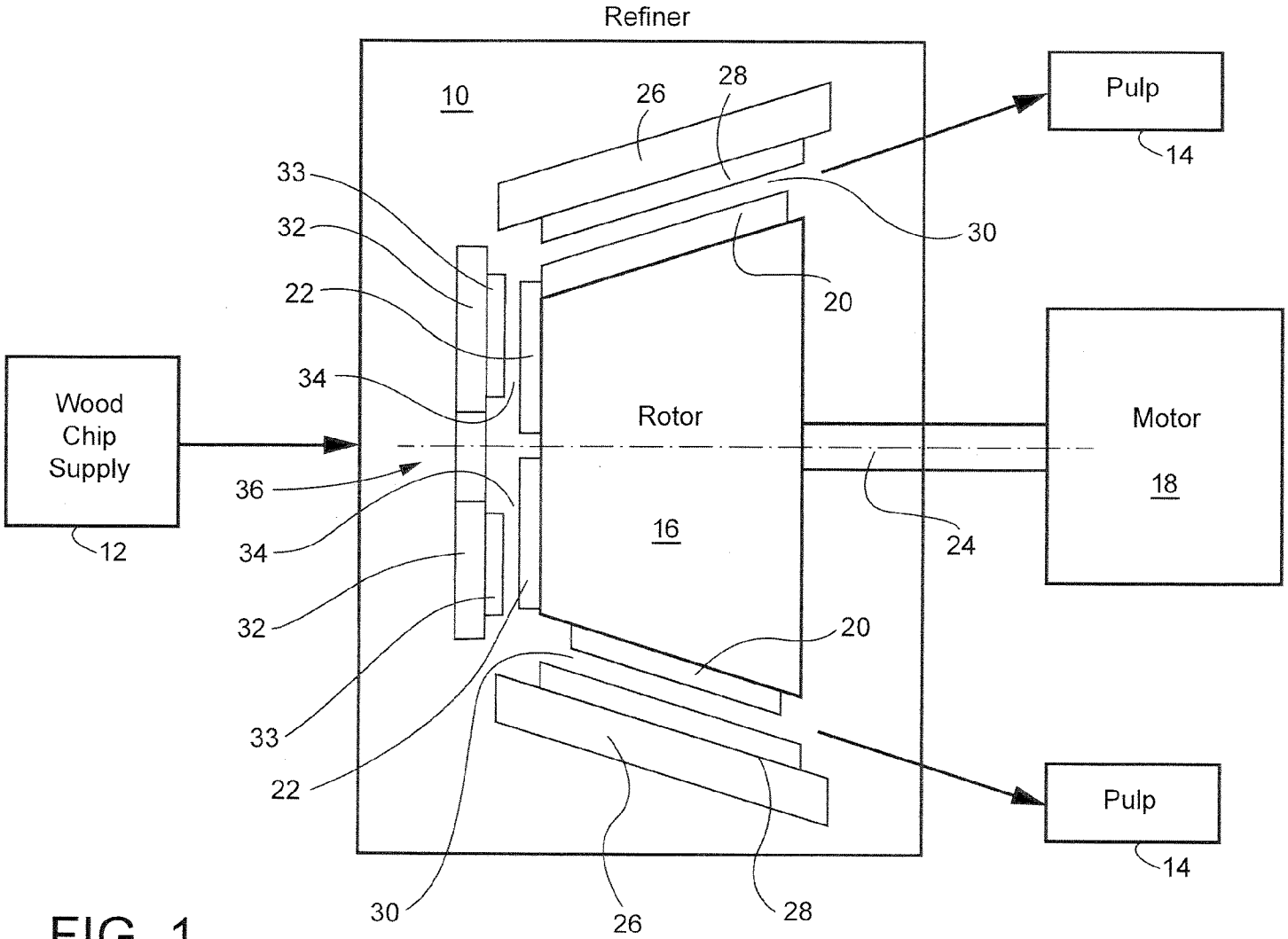
FIG. 1 is a schematic diagram of a conical mechanical refiner for converting cellulosic material to pulp, or for developing pulp.

FIG. 1 is a schematic diagram illustrating a conical refiner or disc-conical refiner 10 which converts cellulosic material provided from a feed system 12 to pulp 14, or which develops wood pulp from the feed system 12 and results in improved pulp 14. The refiner 10 is a conical or partially conical mechanical refining device. The refiner 10 includes a rotor 16 driven by a motor 18. Rotor refining plates 20 are mounted on the frustoconical surface of the rotor 16. The terms refining plates and refining plate segments are used interchangeably in this disclosure. Additional rotor refining plates 22 may be optionally mounted on a front planar face of the rotor 16. These refining plates rotate with the rotor 16. The rotor refining plates 20 on the frustoconical conical surface of the rotor 16 turn in a generally annular path around the axis 24 of the rotor 16. The rotor refining plates 20 on the front face of the rotor 16 turn in a plane perpendicular to the rotor axis.

The refiner 10 includes a conical stator 26 which surrounds the frustoconical portion of the rotor 16. The stator 26 includes stator refining plates 28 that are opposite the rotor refining plates 20 on the rotor 16. A narrow gap 30 is between the rotor refining plates 20 and stator refining plates 28. Similarly, a stator disc 32 faces the front of the rotor 16. Additional stator refining plates 33 are on the stator disc 32 and are separated by a gap from the additional rotor refining plates 22 on the front of the rotor 16.

Cellulosic material, such as wood chips and pulp, flows into a center inlet 36 along the axis 24 of the rotor 16. As the cellulosic material flows into the gap 34 between the additional rotor and stator refining plates 22 and 33, the cellulosic material is moved radially outward through the gap 34 by centrifugal forces imparted by the rotating rotor refiner plate 22. As the cellulosic material reaches the outer perimeter of the additional rotor and stator refiner plates 22 and 33, it flows into the narrow gap 30 between the rotor and stator refiner plates 20 and 28 on the frustoconical portion of the rotor 16. The cellulosic material moves axially and radially through the narrow gap 30 due to the centrifugal force applied by the rotor 16. As the cellulosic material moves through the gaps 34 and 30, the cellulosic material is subjected to large compression and shear forces which convert the cellulosic material to pulp or further refine the pulp.

Figure 2:
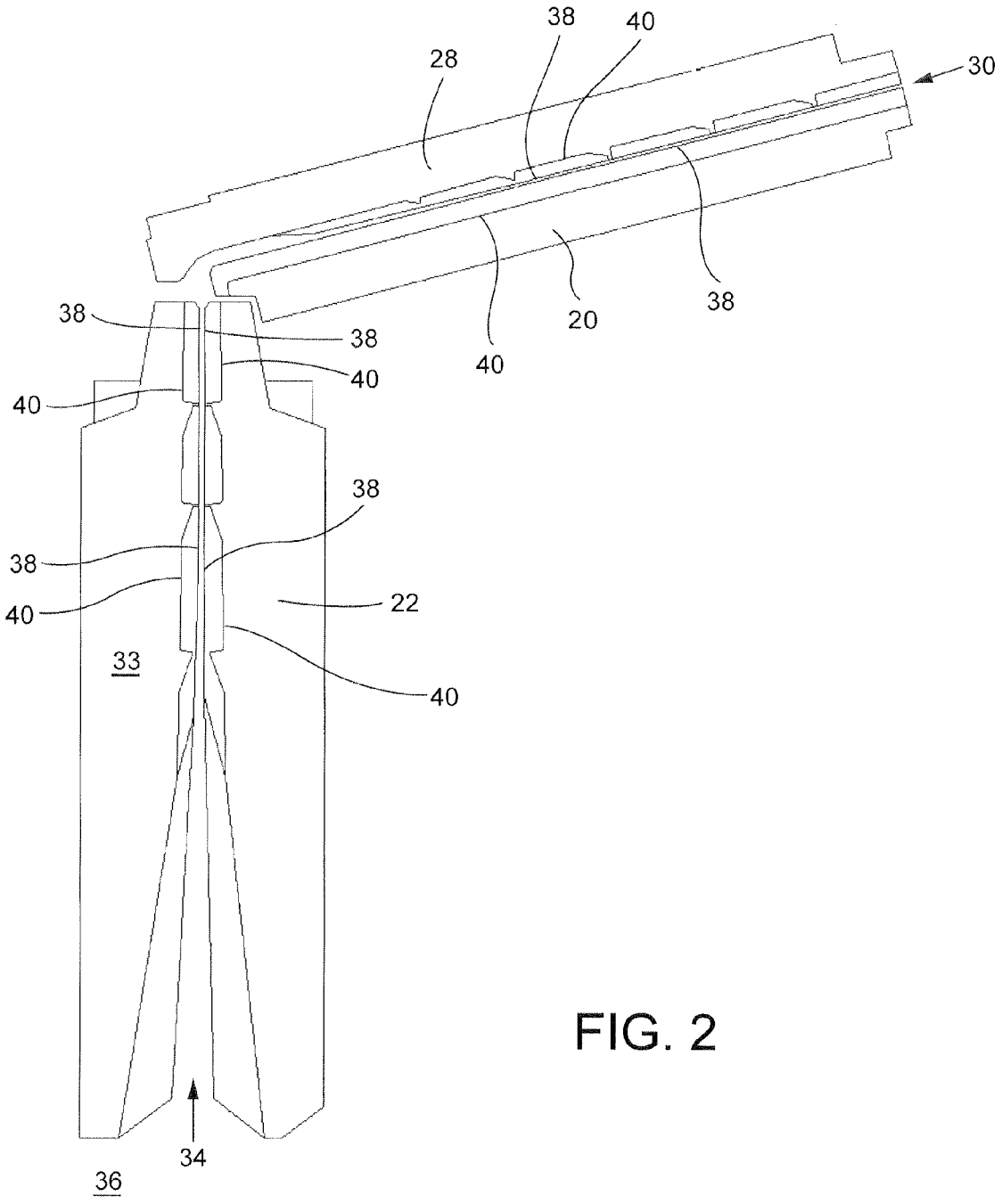
FIG. 2 is a cross-sectional view of a disc-conical refiner plate arrangement.

FIG. 2 is cross-sectional view of a disc-conical refiner plate arrangement showing the gaps 34 and 30 between the conical rotor and stator refining plates 20 and 28 and the additional rotor and stator refining plates 22 and 33. The front face of each refining plate 20, 22, 28, and 33 has a refining pattern formed of bars 38 and grooves 40 which extend generally radially across the front surface of each refining plate 20, 22, 28, or 33. The bottoms of the grooves 40 are at the substrate 41 (FIG. 3) of the each refining plate 20, 22, 28, or 33. Bridges between the grooves extend up from the substrate. The grooves 40 are the volumes between adjacent bars 38 and above the substrate of the plate 20, 22, 28, or 33.

The pattern of bars 38 and grooves 40 can vary widely in terms of the distance between bars 38, the length of bars 38, the longitudinal shape of the bars 38 and other factors. As the plates 20 and 22 move with the rotor 16, the bars 38 on the rotor refining plates 20 and 22 repeatedly cross over the bars on the stator refining plates 28 and 33. The pulsating forces imparted to the fiber pad in the gaps 30 and 34 due to the crossing of the bars 38 is a substantial factor in the shear and compression forces applied to the cellulosic material in the fiber pad.

The refining process applies a cyclical compression and shear to a fibrous pad, formed of cellulosic material, moving in the operating gaps 30 and 34 between the plates of a conical refiner or disc-conical refiner 10. The energy efficiency of the refining process may be improved by reducing the percentage of the refining energy applied in shear and at lower compression rates. The increased compression rate is achieved with the plate designs disclosed herein by the coarse bars with jagged leading sidewalls at the radially outward regions of the plates. The amount of shearing is reduced by relatively wide operating gaps 30 or 34, which are wide as compared to conventional higher energy efficiency refiner plates.

A relatively wide operating gap 30 or 34 between the rotor and stator refining plates 20, 22, 28, and in a refiner 10, results in a thicker pulp pad formed between the plates 20, 22, 28, or 33.

High compression forces can be achieved with a thick pulp pad using a significantly coarser refiner plate, as compared to conventional rotor plates used in similar high energy efficiency applications. A coarse refiner plate has relatively few bars 38 as compared to a fine refiner plate typically used in high energy efficiency refiners. The fewer number of bars 38 reduces the compression cycles applied as the bars 38 on the rotor 16 pass across the bars 38 on the stator 26. The energy being transferred into fewer compression cycles increases the intensity of each compression and shear event and increase energy efficiency.

The rotor refiner plate 20 and 22 designs disclosed herein achieve high fiber retention and high compression to provide high energy efficiency while preserving fiber length and improving wear life of the refiner plates. These designs are to be used in convex conical rotor refiner plates 20 for conical and disc-conical refiners, where any existing or new stator plate design may be used on the concave conical stator refining plates 28.

Figure 3:
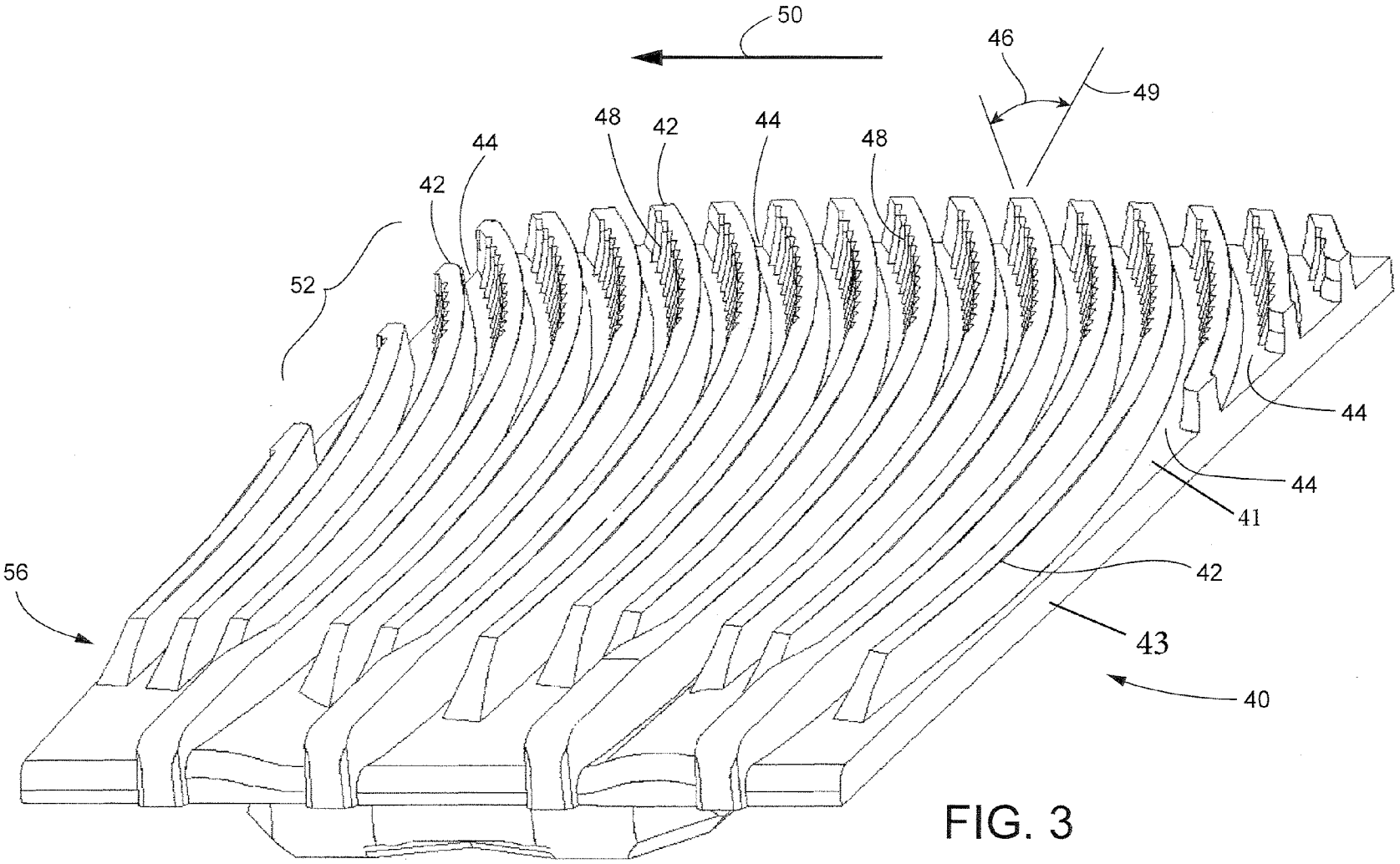
FIG. 3 is a perspective view of a conical rotor refiner plate segment.

FIG. 3 is a perspective view of a refiner plate 40 for a conical rotor 16. The refiner plate 40 may have a relatively coarse bar 42 and groove 44 arrangement wherein the separation between bars 42 is greater than with conventional high energy rotor refining plates. The bars 42 may have a back swept angle 46 at their outer perimeter and jagged surfaces on the leading face of the sidewalls in the direction 50 of rotation. These features increase the retention time of the fibrous pad in the radially outward portion 52 the plate 40. The outward portion 52 is generally the most effective portion for refining because this portion 52 applies much of the energy to the fiber pad in the operating gap 30 or 34. The back swept angle 46 and jagged surfaces 48 on the sidewall concentrate the refining energy, applied to the pulp in the radially outward portion 52. These features combine with a coarse bar 42 and groove 44 patterns to reduce the frequency of bar crossings (less compression events) and substantially increase the fiber retention period in the radially outward portion 52 of the refining zone. The lower frequency of compressions applied to the fiber pad, longer period of the pad in the radially outward portion 52, and relatively wide operating gap 30 or 34 achieve a high compression rate of a thick fiber mat.

Conventional low energy refining plates may have narrow operating gaps to reduce the amount of fiber between the opposing plates and thereby concentrate the energy on a relatively small accumulation of pulp. In contrast, high intensity compressions are achieved with the refining plate 40 such that the operating gap 30, 34 may be relatively wide and thereby increase the amount of fiber present at each bar crossing and the capacity of the refiner to process cellulosic material.

The refiner plate 40 may have curved bars 42 with jagged surfaces 48 on the leading sidewalls at least in the radially outward portion 52 of the conical refining zone. The curvature 46 and jagged surfaces 48 on the leading sidewalls of the bars 42 slows the fibrous mat and thereby increases the retention of the pulp in the radially outward portion 52 of the refining zone. The increased retention period allows for greater energy input towards the periphery of the refiner where energy input into the pulp is more efficient.

The jagged surfaces 48 of the leading sidewall may be of various sizes and shapes. The surfaces 48 may include outer protrusions having jagged corners, e.g., points on a saw-tooth shape and corners in a series of "7" shape, that are spaced apart from each other by between 3 mm to 8 mm along the length of the bar. The protrusions of the jagged surfaces 48 on the leading sidewall edge have a depth of, for example, between 1.0 mm to 2.5 mm, where the depth extends into the bar width. The depth of the protrusions may be limited by the width of the bars 42. A bar 42 may have an average width of between 2.5 mm and 6.5 mm. The bar 42 width varies due to the jagged surface 48 features, particularly the protrusions, on the leading sidewall.

In another embodiment, recesses in the surface of the bars 42 replace the protrusions. The recesses are not shown in the drawings, but would be in the same locations and have the same dimensions as the protrusions.

The swept back angle 46 on the bars 42 may be a progressively increasing angle. The angle 46 between a bar 42 and a reference line 49 parallel to the axis 24 (or parallel to a side edge 43 of the refiner plate segment) and the conical surface of the rotor 16 may be zero or within ten, fifteen or twenty degrees of the reference line 49 at the radially inward inlet 56 region of the refiner plate. The angle 46 may increase at least ten to fifteen degrees as the angle 46 moves radially and axially outward along the bar 42. At the outer periphery of the refiner plate 40, the angle 46 is a holdback angle and may be in a range of any of 10 to 45, 15 to 35, 15 to 45 and 20 to 35 degrees.

Figure 6:
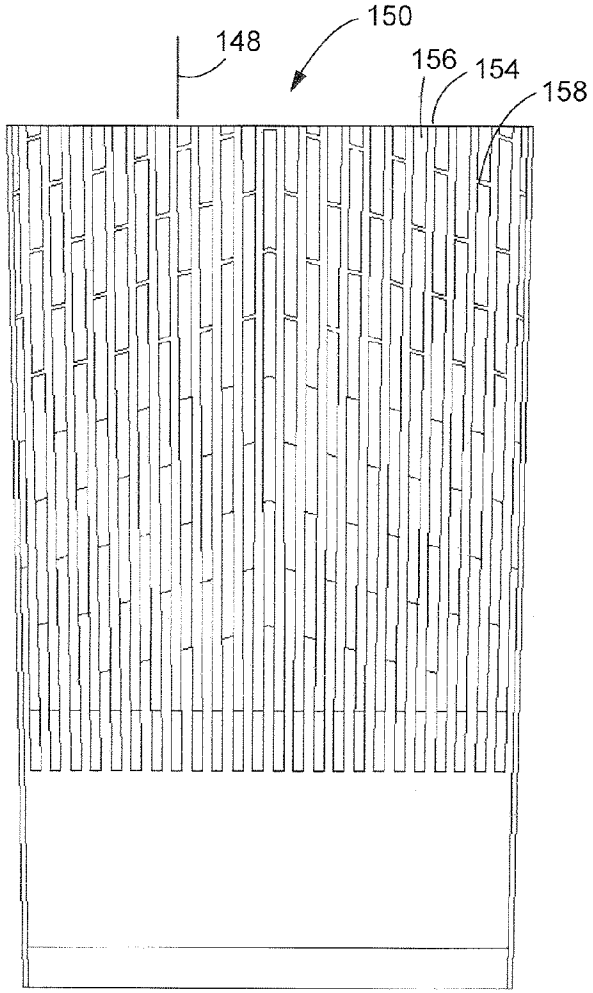
FIG. 6 shows top view of a conventional concave conical stator plate that could be used opposing the novel rotor design.
Figure 5:
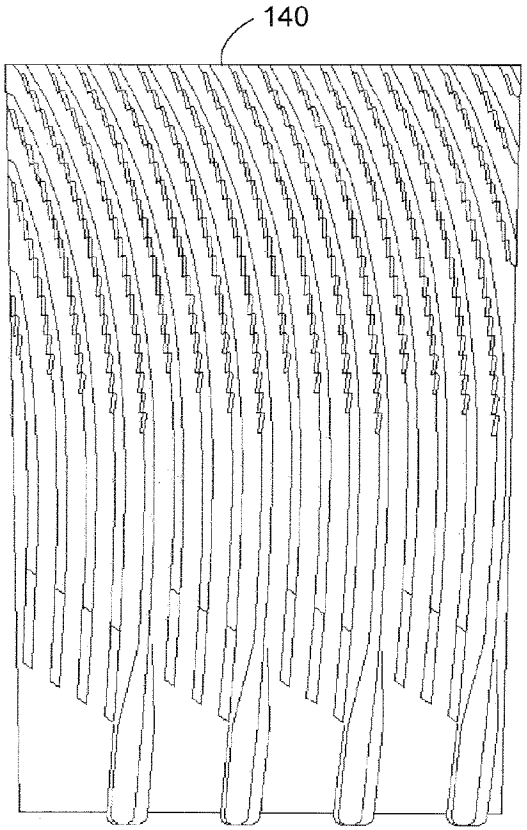
FIG. 5 shows a top view of a convex conical rotor design.
Figure 4:
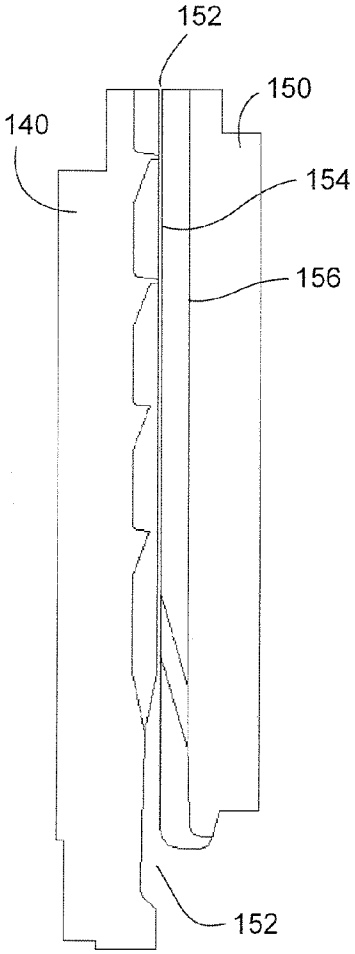
FIG. 4 shows a cross-section of rotor and stator conical zone plates.

FIGS. 4, 5 and 6 are a cross-section of rotor and stator conical zone plates, a top view of a convex conical rotor design, and a top view of a conventional concave conical stator plate that could be used opposing the novel rotor design, respectively. A conical rotor plate 140 and a conical stator plate 150, which are separated by an operating gap 152, are shown. The rotor plate 140 is described above. The stator plate 150 may include bars 154 and grooves 156 that are parallel to the reference line 148, or at any angle deemed to be desirable. Dams 158 may be arranged in the grooves 156 to slow the movement of fibers through the grooves 156 and to cause fibers moving deep in the grooves 156 to flow up toward the ridges of the dams 158. The plate design for the stator plate 150 may be a conventional plate design or a yet to be developed stator plate design, and may still be used with the rotor plate 140 designs disclosed herein.

The stator and refiner plates 140 and 150 may have a slight convex or concave curvature to seat on the corresponding surface of the stator or rotor. The stator plates 150 are arranged in an annular array on the stator. Similarly, the rotor plates 140 are arranged in an annular array on the frustoconical portion of the rotor.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims.

What is claimed is:

1. A refining plate segment for a conical mechanical refiner of lignocellulosic material comprising:

a substrate having a surface, the surface being convex in a cross section, the cross section extending from one side of the refining plate segment to an opposite side of the refining plate segment, bars extend from the surface of the substrate, and grooves formed between adjacent ones of the bars;

wherein the bars and grooves extend along the surface of the substrate to an outer edge of the substrate;

each bar forms an angle with respect to a reference line parallel to a side edge of the refiner plate segment, wherein the angle increases at least 15 degrees along a length of each of the bars, and the angle at an outer end of each of the bars is in a range of 10 to 20 degrees, and wherein the bars each include a leading sidewall having an irregular surface, wherein the irregular surface includes protrusions extending outwardly from the sidewall toward a sidewall on an adjacent one of the bars, and the irregular surface extends from at or near the outer edge of the substrate and extends inward along each of the bars.

2. The refining plate segment of claim 1 wherein the bars each have a curved longitudinal shape.

3. The refining plate segment of claim 1 wherein the angle increases continuously and gradually along each of the bars.

4. The refining plate segment of claim 1 wherein the angle increases in steps.

5. The refining plate segment of claim 1 wherein the angle of each of the bars at an inlet end of the bars is no greater than 20 degrees.

6. The refining plate segment of claim 1 wherein the refining plate segment is adapted to be assembled with additional refining plate segments to form a rotating refining cone.

7. The refining plate segment of claim 1 wherein the bars and grooves are arranged in multiple refining zones, wherein the bars and grooves of a first refining zone are wider than the bars and grooves of a second refining zone, and wherein the second refining zone is outward on the refining plate segment from the first refining zone.

8. The refining plate segment of claim 7 wherein the angle refers to the bars of the second refining zone.

9. The refining plate segment of claim 1 wherein the irregular surface includes a series of ramps, each having a lower edge at the surface of the substrate and extends at least partially up the leading sidewall.

10. The refining plate segment of claim 1 wherein the irregular surface extends along a length of each of the bars without reaching the inlet of the bars.

11. The refining plate segment of claim 1 wherein the irregular surface is along a outward portion of the leading sidewalls of the bars and the leading sidewalls of the bars include a smooth surface along an inward portion of the bars, and wherein the angle of the bars with respect to the reference line remains within a range zero to fifteen degrees along the entire length of the inward portion of the bars.

12. The refining plate segment of claim 1 wherein the bars are arranged in groups of at least three bars, and in each of the groups, the bars extend from a first bar to a last bar in a direction opposite to a rotational direction of the mechanical refiner, and in each of the groups, the irregular surface of each of bars extends further inwardly than does the next bar in the group in the direction opposite to a direction of rotation of the refining plate segment, except for the last bar in the group that has the irregular surface extending further inwardly than the other bars of the group.

13. The refining plate of claim 1 wherein an angle between the reference line and an innermost region of the irregular surface on the leading sidewalls of each of the bars is in a range zero to ten degrees.

14. A refiner plate segment for a mechanical refiner of lignocellulosic material comprising:

a substrate having a surface with a convex shape in a cross section extending from one side of the refiner plate to an opposite side of the refiner plate, and the refiner plate segment is adapted to face an opposing refiner plate segment having a concave shape in a cross section, and bars extending from the surface of the substrate and grooves between the bars, wherein the bars each have an inlet end and an outlet end, and each bar at the outlet end forms an angle in a range of any of 10 to 20 degrees with respect to a reference line parallel to a side edge of the refiner plate segment, wherein the bars each include a leading sidewall having an irregular surface, wherein the irregular surface includes protrusions extending outwardly from the leading sidewall toward a sidewall on an adjacent one of the bars and the irregular surface extends from at or near the outlet end of each of the bars and extends radially inwardly along the bar.

15. The refining plate of claim 14 wherein the bars each have a curved longitudinal shape.

16. The refining plate segment of claim 14 wherein the angle increases continuously and gradually along the bars.

17. The refining plate segment of claim 14 wherein the angle increases in steps along the bars.

18. The refining plate segment of claim 14 wherein the angle is no greater than 20 degrees at the inlet end of the bars.

19. The refining plate segment of claim 14 wherein the refining plate segment is adapted to be assembled with other refining plates segments to form a rotating refining cone.

20. The refiner plate segment of claim 14 wherein the protrusions of the irregular surface form a pattern that is at least one of a zig-zag, sawtooth, series of bumps, sinusoid, or a sideways Z-pattern.

21. The refiner plate segment of claim 14 wherein the protrusions on the irregular surface vary the width of each of the bars by at least one-fifth the width of the bar along the portion of the bar having the sidewall with the irregular surface.

22. The refining plate segment of claim 14 wherein the protrusions of the irregular surface are most pronounced at an upper edge of the sidewall and are less pronounced proximate a substrate of the plate.

23. The refining plate segment of claim 14 wherein the bars and grooves are arranged in multiple refining zones, wherein the bars and grooves in a first refining zone are wider than the bars and grooves in and a second refining zone, and wherein the second refining zone is outward on the refining plate segment from the first refining zone.

24. The refining plate of claim 23 wherein the angle refers to the bars of the second refining zone.

25. The refining plate of claim 14 wherein the irregular surface includes a series of ramps each having a lower edge at the substrate of each groove, extending at least partially up the leading sidewall.

26. The refining plate of claim 14 wherein the irregular surface extends along each of the bars without reaching an inlet to the bar.

27. The refining plate segment of claim 14 wherein the irregular surface is along an outward portion of the leading sidewalls of the bars and the leading sidewalls of the bars include a smooth surface along an inward portion of the bars, and wherein an angle of the bars with respect to the reference line remains within a range zero to fifteen degrees along the entire length of the inward portion of the bars.

28. The refining plate segment of claim 14 wherein the bars are arranged in groups of three or more bars, and in each of the groups, the bars extend from a first bar to a last bar in a direction opposite to a rotational direction of the refining plate segment, and in each of the groups, the irregular surface of each of bars extends further inwardly than does the next bar in the group in the direction opposite to a direction of rotation of the mechanical refiner, except for the last bar in the group that has the irregular surface extending further inwardly than the other bars of the group.

29. The refining plate of claim 14 wherein an angle between the reference line and each of the bars at an innermost region of the irregular surface on the leading sidewalls is in a range zero to ten degrees.

30. The refining plate of claim 14 wherein an angle between the reference line and each of the bars at a radially innermost region of the irregular surface on the leading sidewalls is in a range zero to ten degrees.

31. A refining plate segment for a mechanical refiner of lignocellulosic material comprising:

a substrate with a surface having a convex shape in a cross section extending between opposite sides of the refining plate segment, wherein the surface of the refining plate segment is adapted to face an opposing refiner plate segment having a concave shape in cross section;

the surface of the substrate including bars and grooves between the bars, wherein each bar is at an angle with respect to a reference line parallel to a side edge of the refiner plate segment, and the angle at the inlet to the bars is no greater than 20 degrees, the angle increases at least 15 degrees in an outward direction along the bar, and the angle is in a range of 10 to 20 degrees at an outer end of the bar, and wherein the bars each include a leading sidewall having an irregular surface, wherein the irregular surface includes protrusions extending outwardly from the sidewall toward a sidewall on an adjacent one of the bars, and the irregular surface extends from at or near the outer end of the bar and inwards along the bar.

32. The refining plate segment of claim 31 wherein the bars each have a curved longitudinal shape.

33. The refining plate segment of claim 31 wherein the angles increase continuously and gradually.

34. The refining plate segment of claim 31 wherein the angle increases in steps.

35. The refining plate segment of claim 31 wherein the refining plate segment is adapted to be assembled with other refining plate segments to form a rotating refining cone.

36. The refiner plate segment of claim 31 wherein the protrusions of the irregular surface form a pattern that is at least one of a zig-zag, sawtooth, series of bumps, sinusoid, or a sideways Z-pattern.

37. The refiner plate segment of claim 31 wherein the protrusions on the irregular surface vary the width of the bar by at least one-fifth the width of the bar along the portion of the bar having the sidewall with the irregular surface.

38. The refining plate segment of claim 31 wherein the protrusions of the irregular surface are most pronounced at an upper edge of the sidewall and are less pronounced proximate the substrate.

39. The refining plate segment of claim 31 wherein the bars and grooves are wide in a first refining zone and narrow in a second refining zone, and the second refining zone is outward from the first refining zone.

40. The refining plate segment of claim 39 wherein the angle refers to the bars of the second refining zone.

41. The refining plate segment of claim 31 wherein the irregular surface includes ramps each having a lower edge at the substrate of each groove, extending at least partially up the leading sidewall.

42. The refining plate segment of claim 31 wherein the irregular surface is along a radially outward portion of the leading sidewalls of the bars and the leading sidewalls of the bars include a smooth surface along a radially inward portion of the bars, and wherein an angle of the bars with respect to the reference line remains within a range zero to fifteen degrees along the entire length of the radially inward portion of the bars.

43. The refining plate segment of claim 31 wherein the bars are arranged in groups of three or more bars, and in each of the groups, the bars extend from a first bar to a last bar in a direction opposite to a rotational direction of the refining plate segment, and in each of the groups, the irregular surface of each of bars extends further radially inwardly than does the next bar in the group in the direction opposite to a direction of rotation of the mechanical refiner, except for the last bar in the group that has the irregular surface extending further radially inwardly than the other bars of the group.

44. The refining plate of claim 31 wherein an angle between the reference line and each of the bars at an innermost region of the irregular surface on the leading sidewalls is in a range zero to ten degrees.

45. A convex conical refining plate segment for a mechanical refiner of lignocellulosic material comprising:

a substrate having a convex shape in a cross section extending between opposite sides of the refining plate segment, wherein the refining plate segment is adapted to face an opposing refiner plate segment having a concave shape in cross section;

bars extending from the substrate, and grooves between pairs of the bars extending from the substrate to tops of each of pair of bars, wherein each bar is at an angle with respect to a reference line parallel to a side edge of the refiner plate segment, and the angle at an inlet to the bars is no greater than 20 degrees of the reference line, the angle increases at least 15 degrees in a radially outward direction along the bar, and the angle is in a range of 10 to 20 degrees at an outer end of the bar, and wherein the bars each include a leading sidewall having an irregular surface, wherein the irregular surface includes recesses extending inwardly from the sidewall away from a sidewall on an adjacent one of the bars, and the irregular surface extends from at or near the outer end of the bar and extends inward along the bar.

46. The refining plate segment of claim 45 wherein the irregular surface comprises a semi-circular or rectangular shape.

47. The refining plate segment of claim 45 wherein the refiner plate segment is configured for a high consistency refiner.

48. The refining plate segment of claim 45 wherein the refiner plate segment is configured for a medium consistency refiner.

49. The refining plate segment of claim 45 wherein the refiner plate segment is configured to process the lignocellulosic material at consistencies below 6%.

50. The refining plate segment of claim 45 wherein the irregular surface extends along the bar without reaching the inlet of the bar.

51. The refining plate segment of claim 45 wherein the irregular surface is along an outward portion of the leading sidewalls of the bars and the leading sidewalls of the bars include a smooth surface along an inward portion of the bars, and wherein an angle of the bars with respect to the reference line remains within a range zero to fifteen degrees along the entire length of the inward portion of the bars.

52. The refining plate segment of claim 45 wherein the bars are arranged in groups of three or more bars, and in each of the groups, the bars extend from a first bar to a last bar in a direction opposite to a rotational direction of the refining plate segment, and in each of the groups, the irregular surface of each of bars extends further radially inwardly than does the next bar in the group in the direction opposite to a direction of rotation of the mechanical refiner, except for the last bar in the group that has the irregular surface extending further radially inwardly than the other bars of the group.

* * * * *